US010202757B2

(12) United States Patent
Kadavy

(10) Patent No.: US 10,202,757 B2
(45) Date of Patent: Feb. 12, 2019

(54) WATER MANAGEMENT SYSTEM FOR PANEL-SIDED WALLS

(71) Applicant: Dale R. Kadavy, Overland Park, KS (US)

(72) Inventor: Dale R. Kadavy, Overland Park, KS (US)

( * ) Notice: Subject to any disclaimer, the term of this patent is extended or adjusted under 35 U.S.C. 154(b) by 0 days.

(21) Appl. No.: 15/667,160

(22) Filed: Aug. 2, 2017

(65) Prior Publication Data

US 2018/0038096 A1 Feb. 8, 2018

Related U.S. Application Data

(60) Provisional application No. 62/369,815, filed on Aug. 2, 2016.

(51) Int. Cl.

| | |
|---|---|
| ***E04B 1/68*** | (2006.01) |
| ***E04B 1/70*** | (2006.01) |
| ***E04F 17/00*** | (2006.01) |

(52) U.S. Cl.

CPC ..... *E04B 1/6803* (2013.01); *E04B 1/70* (2013.01); *E04F 17/00* (2013.01)

(58) Field of Classification Search

CPC ..... E04F 17/00; E04B 1/6803; E04B 1/70

USPC ..... 52/302.3, 302.1, 302.4

See application file for complete search history.

(56) References Cited

U.S. PATENT DOCUMENTS

| | | | | |
|---|---|---|---|---|
| 4,910,938 A * | 3/1990 | McGee | E04B 1/34321 | 52/481.2 |
| 5,212,914 A * | 5/1993 | Martin | E04F 13/12 | 52/235 |
| 5,222,343 A * | 6/1993 | Anderson | E04F 19/061 | 52/211 |
| 5,598,671 A | 2/1997 | Ting | | |
| 5,687,524 A * | 11/1997 | Ting | E04B 2/965 | 52/235 |
| 5,802,777 A * | 9/1998 | Sato | E04D 13/076 | 52/11 |
| 6,745,527 B1 * | 6/2004 | Sherman | E04B 2/96 | 52/235 |
| 6,823,633 B2 * | 11/2004 | Ryan | E04F 13/0889 | 52/15 |

(Continued)

FOREIGN PATENT DOCUMENTS

WO 2017041178 3/2017

*Primary Examiner* — Joshua K Ihezie

(74) *Attorney, Agent, or Firm* — Hovey Williams LLP

(57) ABSTRACT

The present invention is directed to systems and methods for improving the water management of exterior walls clad with panel siding. The present invention improves on prior art wall designs by directing water on the exterior surface of a building away from areas which are vulnerable to water penetration, such as joints between panels, joints between trim components, and locations where fasteners are driven from the exterior. The water management system generally comprises a vertical batten assembly, and in certain embodiments a horizontal joint cover. The water management system is designed to be installed on an outer surface of the exterior wall panels. Thus, the system may be installed without removing and replacing existing siding or covering panels with an entirely new layer of siding. The present invention may also be used on new panel siding installations as a lower cost alternative to other siding systems.

8 Claims, 12 Drawing Sheets

(56) References Cited

U.S. PATENT DOCUMENTS 6,988,344 B1 * 1/2006 Krueger ..... F16B 5/0614 52/464
7,562,509 B2 * 7/2009 Ness ..... E04F 13/081 52/235
7,614,192 B2 * 11/2009 Safie ..... E02D 29/0258 52/302.1
7,712,276 B2 5/2010 Gilbert et al.
7,794,176 B2 * 9/2010 Musser ..... E03F 3/046 404/4
8,336,273 B2 12/2012 Enns
8,490,350 B1 * 7/2013 Greely ..... E06B 1/34 52/211
8,516,765 B2 8/2013 Shaw et al.
8,695,303 B2 4/2014 Swanson
8,756,892 B2 6/2014 Wilson et al.
9,140,007 B2 * 9/2015 Beaty ..... E04B 2/16
9,267,280 B2 2/2016 Sawatzky et al.
9,394,696 B2 7/2016 Norwood et al.
2003/0046888 A1 * 3/2003 Ryan ..... E04B 2/88 52/302.1
2005/0060950 A1 * 3/2005 Hauschildt ..... E04F 13/0814 52/235
2006/0283113 A1 * 12/2006 Trotter ..... E04B 1/7023 52/302.3
2007/0180785 A1 * 8/2007 Trotter ..... E02D 31/02 52/302.1
2008/0134594 A1 * 6/2008 Ness ..... E04F 13/081 52/200
2008/0163582 A1 * 7/2008 Trevethick ..... E04B 1/70 52/716.2
2009/0007509 A1 * 1/2009 Jordan ..... E02D 31/02 52/302.1
2009/0183453 A1 * 7/2009 Koessler ..... E04F 13/007 52/302.3
2010/0146893 A1 6/2010 Dickinson
2011/0252731 A1 10/2011 Boyer et al.
2012/0247040 A1 10/2012 Buoni et al.
2012/0255249 A1 * 10/2012 Singh ..... E04F 19/065 52/302.1
2013/0219817 A1 * 8/2013 Hans ..... E06B 7/14 52/302.1
2015/0027074 A1 * 1/2015 Preston ..... E04F 13/06 52/302.1
2016/0312461 A1 10/2016 Naylor et al.

* cited by examiner

WATER MANAGEMENT SYSTEM FOR PANEL-SIDED WALLS

CROSS-REFERENCE TO RELATED APPLICATIONS

This application claims the benefit of U.S. Provisional Application No. 62/369,815, filed Aug. 2, 2016, entitled WATER MANAGEMENT SYSTEM FOR PANEL-SIDED WALLS, which is incorporated herein in its entirety.

BACKGROUND OF THE INVENTION

Field of the Invention

The present invention is directed to systems and methods for improving the water management of exterior walls clad with panel siding. The present invention may be applied to panel siding installations without the need (or cost) of removing and replacing the siding or the cost of covering the existing panel siding with another siding layer. The present invention may also be used on new panel siding installations as a lower cost alternative to other siding alternatives. The system and methods are applicable to, but not limited to, residential construction using "T1-11" style siding and other sheet siding.

Description of the Prior Art

In the United States, residential and light commercial construction using a panel siding system can comprise 2×4 or 2×6 framing with textured plywood or oriented strand board (OSB) panels nailed directly to the framing. Trim boards are also nailed on top of panel siding around windows, at panel joints, or on corners. For this type of construction, a watertight seal is achieved by creating an outer barrier comprising paint and caulking. The panel siding systems require frequent re-painting and re-caulking to remain watertight over time. If the barrier of paint and caulk breaks down, then any differential pressure across the surface of the siding or trim will drive water into and/or between the exterior siding and trim components. The siding and trim components are most vulnerable to water penetration at joints where panels and trim boards connect, and where fasteners penetrate the siding and trim components from the exterior. If exterior components become sufficiently degraded by contact with water, water may penetrate further into the wall structure and may cause damage to insulation, wiring, framing or any material to in the interior of the structure with respect to the outer cladding.

Because panel sided wall systems are designed as barrier systems, they typically have no means of managing water if it penetrates the wall. If the wall system stays wet for prolonged periods of time, consequential damage including mold growth may occur. Other siding systems (including vinyl siding and lap siding) typically use multiple layers of water-resistant materials to prevent water penetration, and these siding systems allow water to exit if it penetrates the outer layer. The multi-layer siding systems with water management are less likely to require repairs than panel-sided buildings if the exterior paint and caulking barrier fails. However, these systems require converting a structure from panel siding to another siding system or covering nearly all the existing panels with an extra layer of siding material. Installation of such systems is costly, requiring significant amounts of labor and material.

SUMMARY OF THE INVENTION

The present invention improves on prior art wall designs by directing water on the exterior surface of the building away from areas which are vulnerable to water penetration. These areas include joints between panels, joints between trim components, and locations where fasteners are driven from the exterior, as well as any other passages where water may penetrate through the panels. The present invention also allows water to run out of the system if it is driven past the outer layer of the system. Because the system is designed specifically to cover vulnerable areas in existing panel siding, the cost of implementing the system is significantly lower than currently-available alternatives.

In one embodiment of the present invention, there is provided a water management system for installation on an outer surface of one or more exterior siding panels. The water management system comprises a batten assembly configured to be secured to the outer surface of the siding panels. The batten assembly comprises an elongated bracket and an outer cover that covers at least a portion of the bracket. The bracket includes opposed first and second major surfaces, with the first major surface configured to be positioned adjacent the outer surface of the siding panels. The outer cover is positioned adjacent the second major surface of the bracket and configured to be spaced apart from the outer surface of the siding panels. The water management system further comprises a seal positioned adjacent the first major surface of the bracket and configured to be disposed at least partially between the first major surface and the siding panels. The batten assembly presents a channel running substantially parallel to the elongated bracket and configured to permit fluid to drain from the batten assembly.

In another embodiment, there is provided a method of deterring water penetration through an outer surface of one or more exterior siding panels. The method comprises installing a water management system on the outer surface of the siding panels. The water management system comprises a batten assembly secured to the outer surface of the siding panels and comprising an elongated bracket and an outer cover that covers at least a portion of the bracket. The water management system further comprises a seal positioned adjacent the bracket and disposed at least partially between the bracket and the siding panels. The batten assembly presents a channel running substantially parallel to the elongated bracket and configured to permit fluid to drain from the batten assembly.

In yet another embodiment, there is provided an exterior wall comprising one or more exterior siding panels having an outer surface and a water management system installed thereon. The water management system comprises a batten assembly secured to the outer surface of the siding panels. The batten assembly comprises an elongated bracket and an outer cover that covers at least a portion of the bracket. The bracket includes opposed first and second major surfaces, with the first major surface positioned adjacent the outer surface of the siding panels. The outer cover is positioned adjacent the second major surface of the bracket and spaced apart from the outer surface of the siding panels. The water management system further comprises a seal positioned adjacent the first major surface of the bracket and disposed at least partially between the first major surface and the siding panels. The batten assembly presents a channel running substantially parallel to the elongated bracket and in configured to permit fluid to drain from the batten assembly.

DETAILED DESCRIPTION OF THE PREFERRED EMBODIMENT

Figure 1:
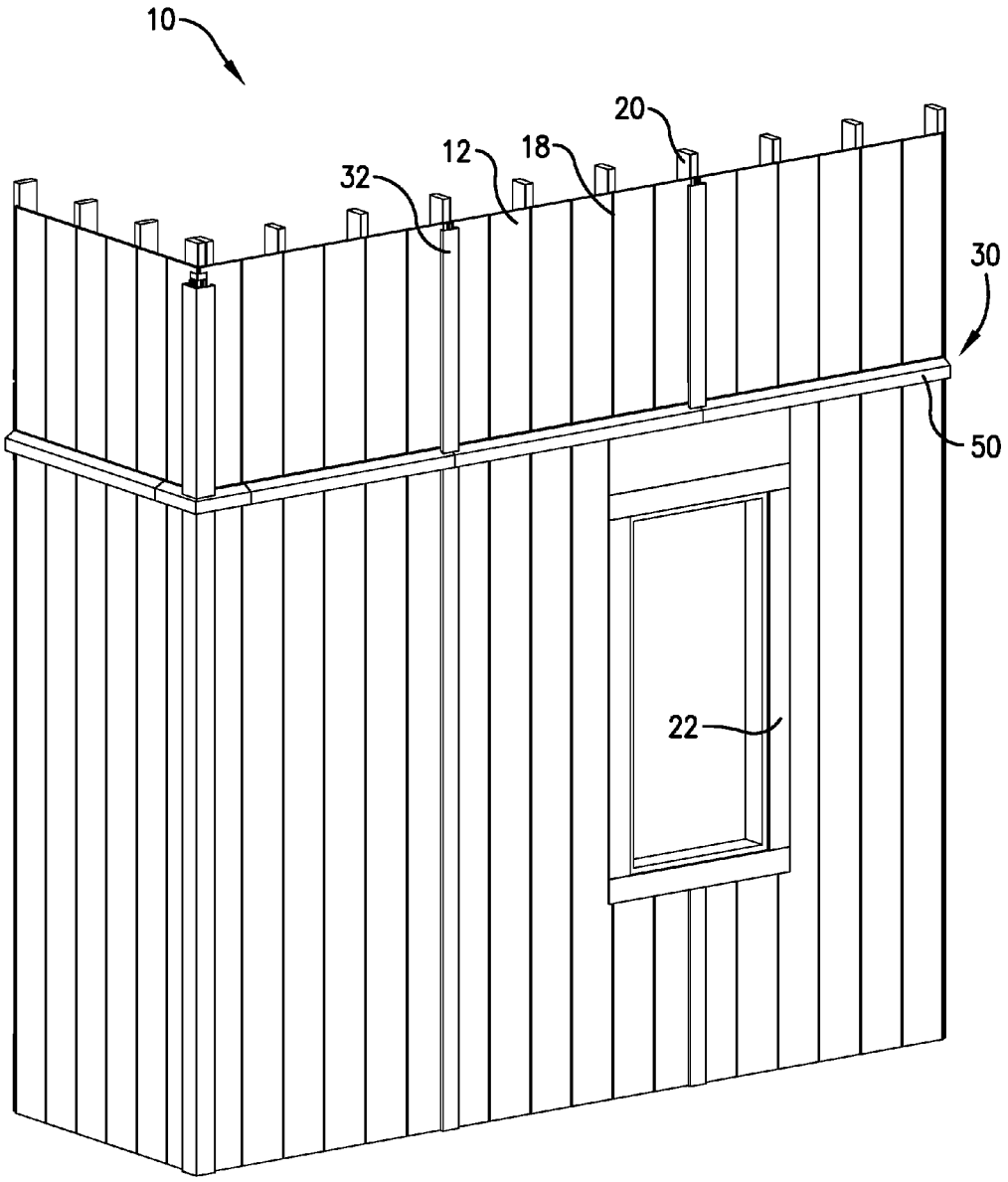
FIG. 1 is a perspective view of an exterior wall comprising a water management system installed thereon, in accordance with one embodiment of the present invention.

Turning to FIG. 1, a water management system 30 is shown installed on an exterior wall in accordance with one embodiment of the present invention. Exterior wall 10 comprises a one or more exterior siding panels 12. Panels 12 can be any of a variety of exterior sheet siding panels known in the art. In particularly preferred embodiments, panels 12 are "T1-11" style siding, such as those shown in FIG. 1. Each panel 12 comprises an outer surface 14 and an inner surface 16, with the inner surface 16 facing and being positioned adjacent wall framing 20. Panels 12 may be fastened directly to framing 20, or other building materials such as a water barrier and/or structural panel may be disposed between inner surface 16 and framing 20. In certain embodiments, each panel 12 comprises one or more vertical grooves 18 running from an upper edge 24 to lower edge 26 of the panel 12.

Water management system 30 is designed to restrict or inhibit water penetration into exterior wall 10. Thus, water management system 30 is installed to cover one or more passages formed on the outer surface 14 of panels 12 that may permit water to flow through outer surface 14 toward inner surface 16 of panels 12. The passages may be any opening that allows water to penetrate the outer surface 14 of panels 12 and contact an internal portion 15 or inner surface 16 of panels 12 or some other component contained within exterior wall 10. The passages may include the gap formed, for example, at a vertical junction (i.e., vertical joint) 28 or horizontal junction (i.e., horizontal joint) 29 where two siding panels 12 meet on exterior wall 10. The passages may also include perforations in exterior surface 14 caused by fasteners used to secure the panels 12 to framing 20. Water management system 30 can be installed on exterior walls comprising windows and/or doors, and thus can be installed to cover passages such as the gaps between panels 12 and window frame 22 or gaps between the panels and door frames (not shown). When installed, water management system 30 generally covers only vulnerable areas (i.e., passages or potential passages) of exterior wall 10, which requires less material and lower costs than prior art systems that are designed to cover the entire exterior surface of the wall. For example, in certain embodiments water management system 30 covers less than about 50%, preferably less than about 25%, and more preferably less than about 10% of the total surface area of the outer surfaces 14 of panels 12 on exterior wall 10.

Figure 2:
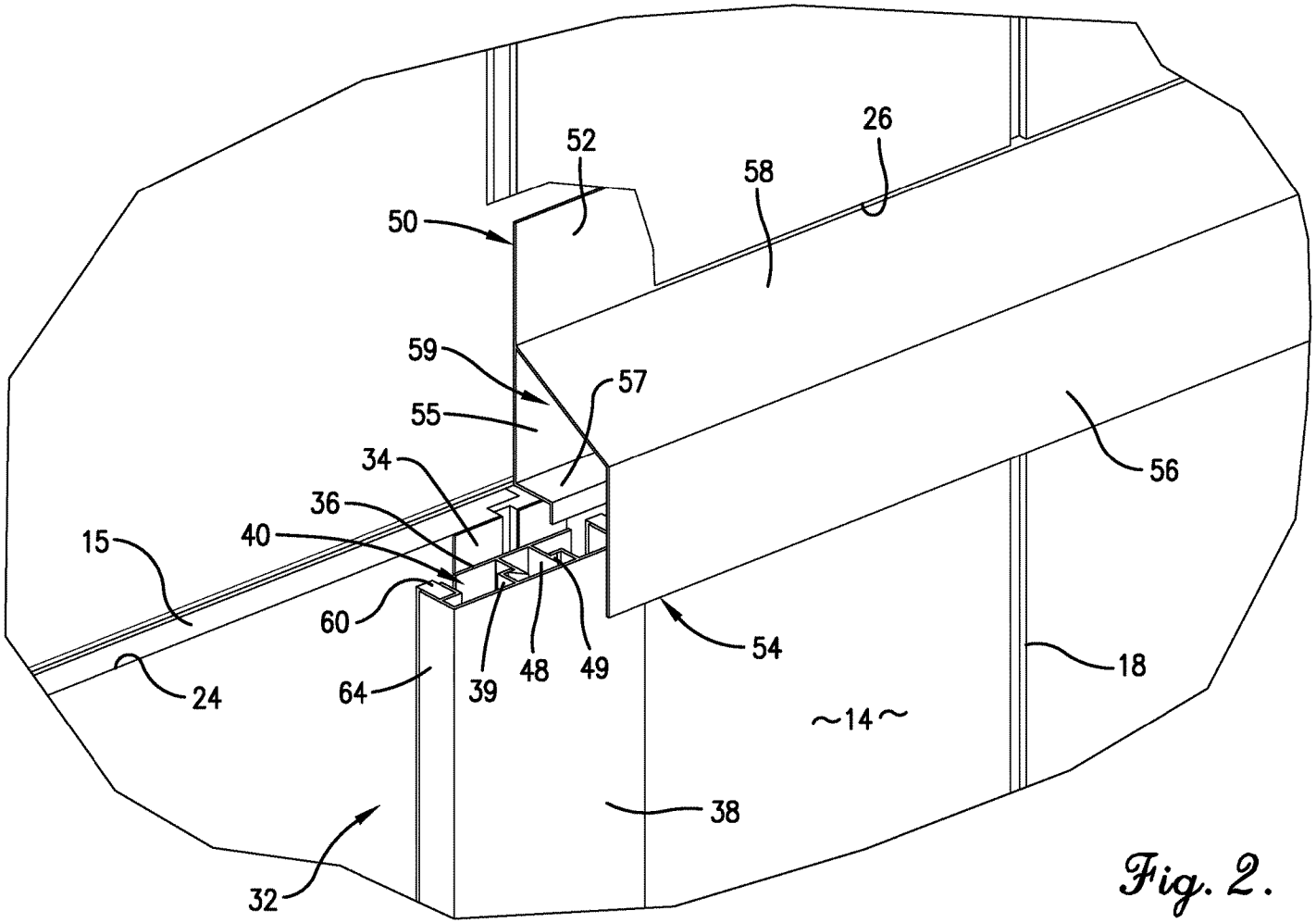
FIG. 2 is an enlarged cutaway perspective view of the water management system installed on the exterior wall of FIG. 1.
Figure 4:
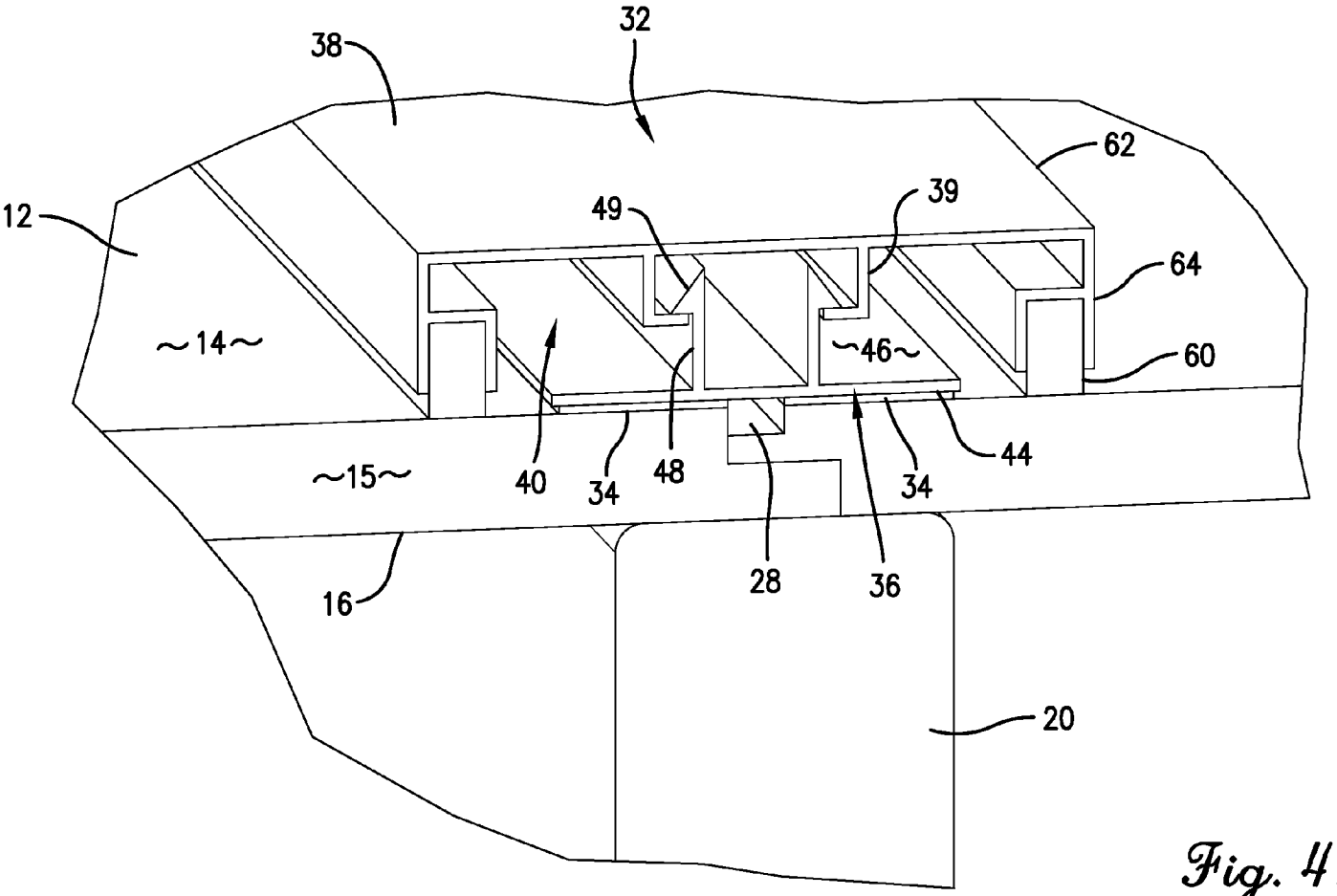
FIG. 4 is a perspective cross-section view of a batten assembly installed on an exterior wall, in accordance with one embodiment of the present invention.

Water management system 30 generally comprises one or more vertical batten assemblies 32 and a seal 34 disposed at least partially between each batten assembly 32 and outer surface 14 of siding panels 12. In certain embodiments, water management system 30 further comprises one or more horizontal joint covers 50. An exemplary vertical batten assembly 32 is best illustrated in FIG. 2 and FIG. 4. Vertical batten assembly 32 generally comprises an elongated bracket 36, an outer cover 38, and a channel 40 running substantially parallel to elongated bracket 36. In certain embodiments, bracket 36 and cover 38 comprise separate components that are attached as shown in FIG. 4. However, in certain other embodiments, bracket 36 and cover 38 may comprise a single, continuous part and do not require an attachment step for installation.

Figure 5:
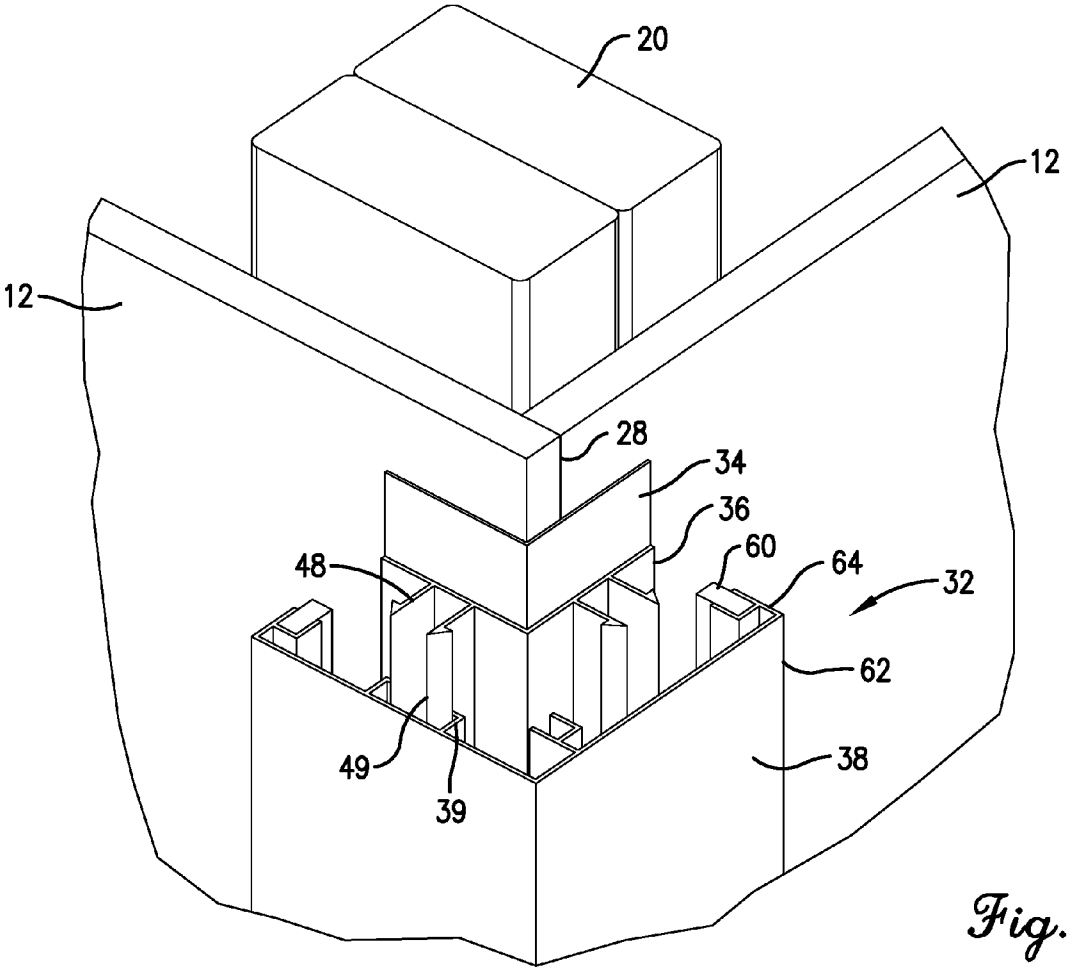
FIG. 5 is a perspective cutaway view of a batten assembly installed on the corner of an exterior wall, in accordance with one embodiment of the present invention.

As shown in FIG. 4, bracket 36 comprises a first major surface 44 positioned adjacent exterior surface 14 of panels 12 and an opposed second major surface 46. In certain embodiments, bracket 36 is secured to panels 12 via seal 34 (described below) disposed between first major surface 44 and exterior surface 14. However, in certain other embodiments, bracket 36 may be secured to panels 12 via adhesives, fasteners (e.g., nails or screws), or other mechanisms known in the art. In certain embodiments, bracket 36 comprises one or more spacers 48 extending from the second major surface 46 away from panels 12. Spacers 48 may comprise latches 49 for securing outer cover 38 to bracket 36. Advantageously, the use of spacers and latches 49 allows outer cover 38 be attached to bracket 36 and panels 12 without fasteners being driven from the exterior of outer cover 38, which could create a passage for water to penetrate to panels 12. Regardless the embodiment, bracket 36 is designed to create adequate air space in channel 40 so that water will not be entrained in the air flow around seal 34. Bracket 36 may comprise a variety of shapes, depending on the specific application. For example, the first major surface 44 of bracket 36 may be flat, curved, angled, or otherwise shaped as needed to follow the siding panels 12, as shown in FIG. 5. Bracket 36 may be made from a variety of materials using a variety of manufacturing processes. In certain embodiments, the bracket 36 comprises a material selected from the group consisting of aluminum, steel (e.g., formed, coated, or stainless steel), plastics or other polymers, fiber-cement, fiberglass, wood, composite materials, and combinations thereof. While bracket 36 is described herein as being a single part, it should be understood that bracket 36 may be comprised of multiple pieces, which may be continuous or segmented. In certain embodiments, elongated bracket 36 has a substantially similar length as outer cover 38. For example, in certain such embodiments, elongated bracket 36 is at least about 75%, preferably at least about 90%, and more preferably at least about 95% the length of outer cover 38. However, in other embodiments, bracket 36 may be significantly shorter in length than outer cover 38, for example less than about 50%, less than about 25%, or less than about 10% the length of outer cover 38.

Outer cover 38 is positioned adjacent the second major surface 46 of bracket 36 spaced apart from the outer surface 14 of siding panels 12. Outer cover 38 is designed to be an aesthetic and functional cover on the exterior of batten assembly 32. In certain embodiments, outer cover 38 comprises one or more receivers 39 extending from an interior surface of outer cover 38 and configured to attach outer cover 38 to bracket 36 via one or more latches 49. However, in certain embodiments, outer cover 38 does not comprise receivers 39, as bracket 36 and cover 38 may comprise a single, continuous part. In certain embodiments, outer cover 38 is constructed to shield seal 34 from rain water, and thus outer cover 38 should generally have a structural strength adequate to withstand wind loads and positive pressure caused by wind and rain against exterior wall 10. Outer cover 38 may comprise a variety of shapes, depending on the specific application. For example, in one or more embodiments, outer cover 38 may be flat, curved, angled, or otherwise shaped as needed to cover bracket 36. In certain preferred embodiments, outer cover 38 is shaped as an elongated planar member or trim board. Outer cover 38 may be made from a variety of materials using a variety of manufacturing processes. In certain embodiments, cover 38 comprises a material selected from the group consisting of aluminum, steel (e.g., formed, coated, or stainless steel), plastics or other polymers, fiber-cement, fiberglass, wood, composite materials, and combinations thereof. Outer cover 38 may be made from the same or different material as bracket 36. While cover 38 is described herein as being a single part, it should be understood that cover 38 may be comprised of multiple pieces, which may be continuous or segmented. Fiber cement, natural wood, or engineered wood may also be used as an aesthetic outer layer (not shown) of outer cover 38.

Channel 40 is designed to direct fluid away from seal 34 and permit the fluid to drain from batten assembly 32. Notably, channel 40 is vented to the external environmental pressure (e.g., the positive pressure on the windward side of a building) and large enough to allow gravity to drain a substantial portion of a fluid (e.g., rain water) within channel 40 from batten assembly 32 before the fluid can contact seal 34. This feature improves the performance and lifespan of seal 34. As shown in FIG. 4, in one or more embodiments, the dimensions of channel 40 are defined by the width of outer cover 38 and the depth of spacers 48 extending from bracket 36. However, in other embodiments, the dimensions of channel 40 may be defined by other components within batten assembly 32. Depending on the embodiment, batten assembly 32 may present a single channel, two channels (FIG. 4), or more than two channels. Regardless the number of channels, however, it is preferred that the channel(s) run substantially parallel to elongated bracket 36 to allow fluid to drain from batten assembly 32.

Seal 34 is positioned adjacent the first major surface 44 of bracket 36 and disposed at least partially between the first major surface 44 and outer surface 14 of siding panels 12. Seal 34 is designed to inhibit or prevent air and water from penetrating through one or more passages formed in the outer surface 14 of panels 12. Thus, in certain preferred embodiments, seal 34 provides an air-tight seal between the one or more passages and the external environment. This air-tight seal resists the positive differential pressure across exterior wall 10 caused by wind and rain, and it inhibits air and water from being driven into or through the siding panels 12. However, in certain other embodiments, seal 34 is capable of inhibiting water penetration through the passages without providing an air-tight seal. In certain embodiments, bracket 36 is configured to shield undesirable water within channel 40 from contacting seal 34. In the same or other embodiments, bracket 36 may be used to compress a seal material against outer surface 14, thereby forming seal 34. Regardless the embodiment, seal 34 is generally installed to substantially cover the one or more passages on the outer surface 14 of panels 12 or places where passages are likely to form (e.g., over caulked or painted fasteners). As shown in FIG. 4, in certain embodiments seal 34 comprises a pair of vertical strips installed on either side of vertical joint 28. In certain other embodiments, seal 34 may be at least partially disposed within vertical joint 28 between adjacent siding panels. Seal 34 may be formed from a variety of materials, and in certain embodiments seal 34 comprises a material selected from the group consisting of curable liquid or gel adhesive sealants, compressible gaskets, adhesive-backed foams, deformable tapes (e.g., butyl), felt, molded or extruded polymers, pile, textiles, cork, tar paper, epoxy, non-curable adhesive sealants, and combinations thereof. Seal 34 may be may be flat, curved, angled, or otherwise shaped to fit between the outer surface 14 of panels 12 and the first major surface 44 of bracket 36.

In one or more embodiments, water management system 30 further comprises a second seal 60 positioned on a peripheral edge 62 of outer cover 38. When present, second seal 60 provides a first water barrier to shield water from being entrained in any inadvertent air flow through seal 34 caused by a positive pressure differential across exterior wall 10. As shown in FIG. 4, in certain embodiments, an outer member 64 extends from peripheral edge 62 of outer cover 38 toward panel 12, and second seal 60 is disposed at least partially between outer cover 38 and outer surface 14 of panel 12. In certain such embodiments, second seal 60 defines a sidewall of channel 40, such that the width of channel 40 is defined by the space between second seal 60 and bracket 36. In certain embodiments, second seal 60 is spaced sufficiently far away from seal 34 to prevent rain water from contacting seal 34. While second seal 60 may be capable of blocking air flow, air-tight sealing is not necessary so long as second seal 60 deters water from contacting seal 34. Additionally, second seal 60 does not need to resist the differential pressure caused by wind, and thus either side of second seal 60 can be exposed to the same pressure environment. Second seal 60 may comprise the same or different materials as seal 34. In certain embodiments second seal 60 comprises a material selected from the group consisting of curable liquid or gel adhesive sealants, compressible gaskets, adhesive-backed foams, deformable tapes (e.g., butyl), felt, molded or extruded polymers, pile, textiles, cork, tar paper, epoxy, non-curable adhesive sealants, and combinations thereof. However, in certain other embodiments, second seal 60 may be formed from segmented, compressible members, such as bristles or fins, which may permit air flow but restrict the movement of bulk water. Second seal 60 may also be formed by leaving a continuous or intermittent narrow gap between the outer surface 14 of panel 12 and outer member 64 of outer cover 38. In such embodiments, the size of the gap and its distance from seal 34 should be designed to inhibit water from reaching seal 34. Second seal 60 may be may be flat, curved, angled, or otherwise shaped to fit between the outer surface 14 of panels 12 and outer cover 38.

Figure 3:
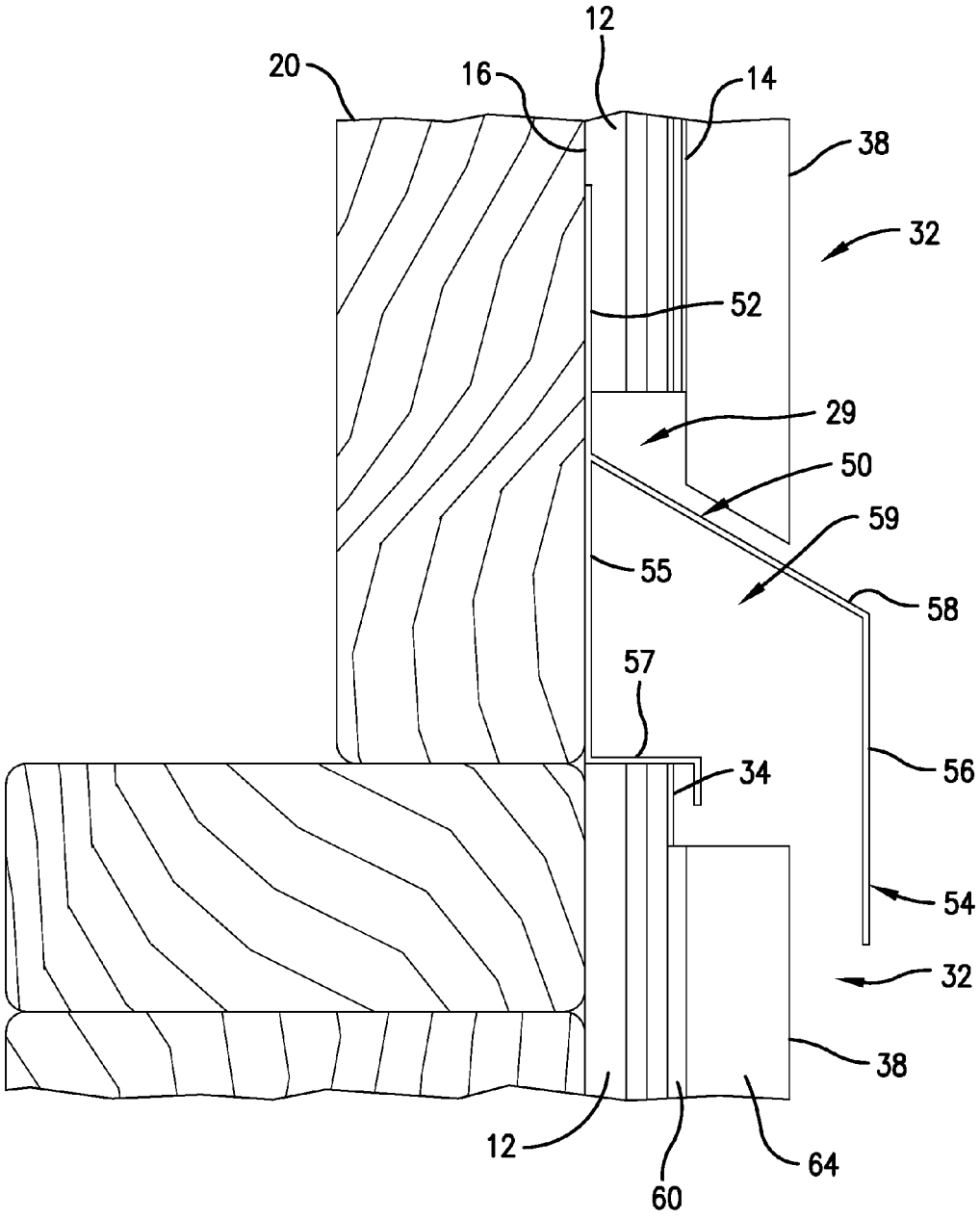
FIG. 3 is a cutaway side view of the water management system installed on the exterior wall of FIG. 1.

In certain embodiments, water management system 30 further comprises horizontal joint cover 50. Horizontal joint cover 50 is designed to cover horizontal junctions (joints) 29 between an upper edge 24 and lower edge 26 of two or more siding panels 12 and inhibit or prevent water penetration between panels 12 or trim members. Horizontal joint cover 50 generally comprises upper flange 52, lower projection 54, and connecting member 58. In certain embodiments, upper flange 52 is installed adjacent to inner surface 16 of the upper panel 12. Lower projection 54 comprises lower flange 55 and spaced-apart overlay 56. Lower projection 54 further presents a cavity 59 at least partially defined by the space between lower flange 55 and overlay 56. Cavity 59 is vented to the external environmental pressure, which allows air to flow through cavity 59 and drain any undesirable water from horizontal joint cover 50. Cavity 59 is further designed to direct water away from the top of seal 34, while allowing dry air to flow through channel 40 of batten assembly 32. In certain embodiments, lower flange 55 comprises horizontal projection 57 positioned along upper edge 24 of the lower siding panel 12, which covers seal 34 from water draining from cavity 59. Connecting member 58 is positioned between upper flange 52 and overlay 56. Connecting member 58 has a generally downward sloping angle from upper flange 52 to overlay 56 to divert fluid away from horizontal junction 29. As shown in FIG. 3, overlay 56 is positioned to cover the top of batten assembly 32, thereby inhibiting any water diverted down connecting member 58 from flowing into the top of batten assembly 32.

Figure 6:
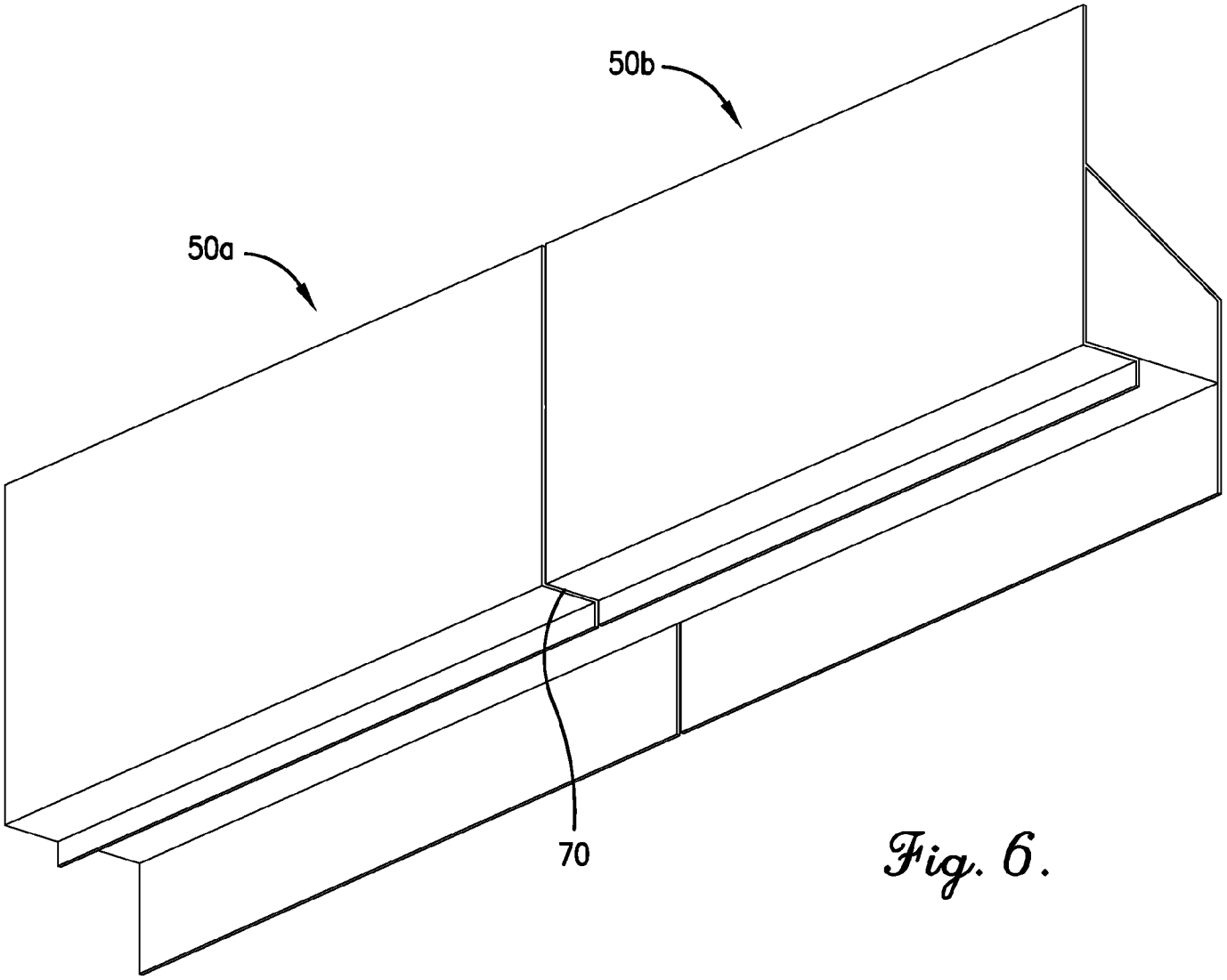
FIG. 6 is a perspective bottom view of two horizontal joint covers having a seal in the gap therebetween, in accordance with one embodiment of the present invention.
Figure 7:
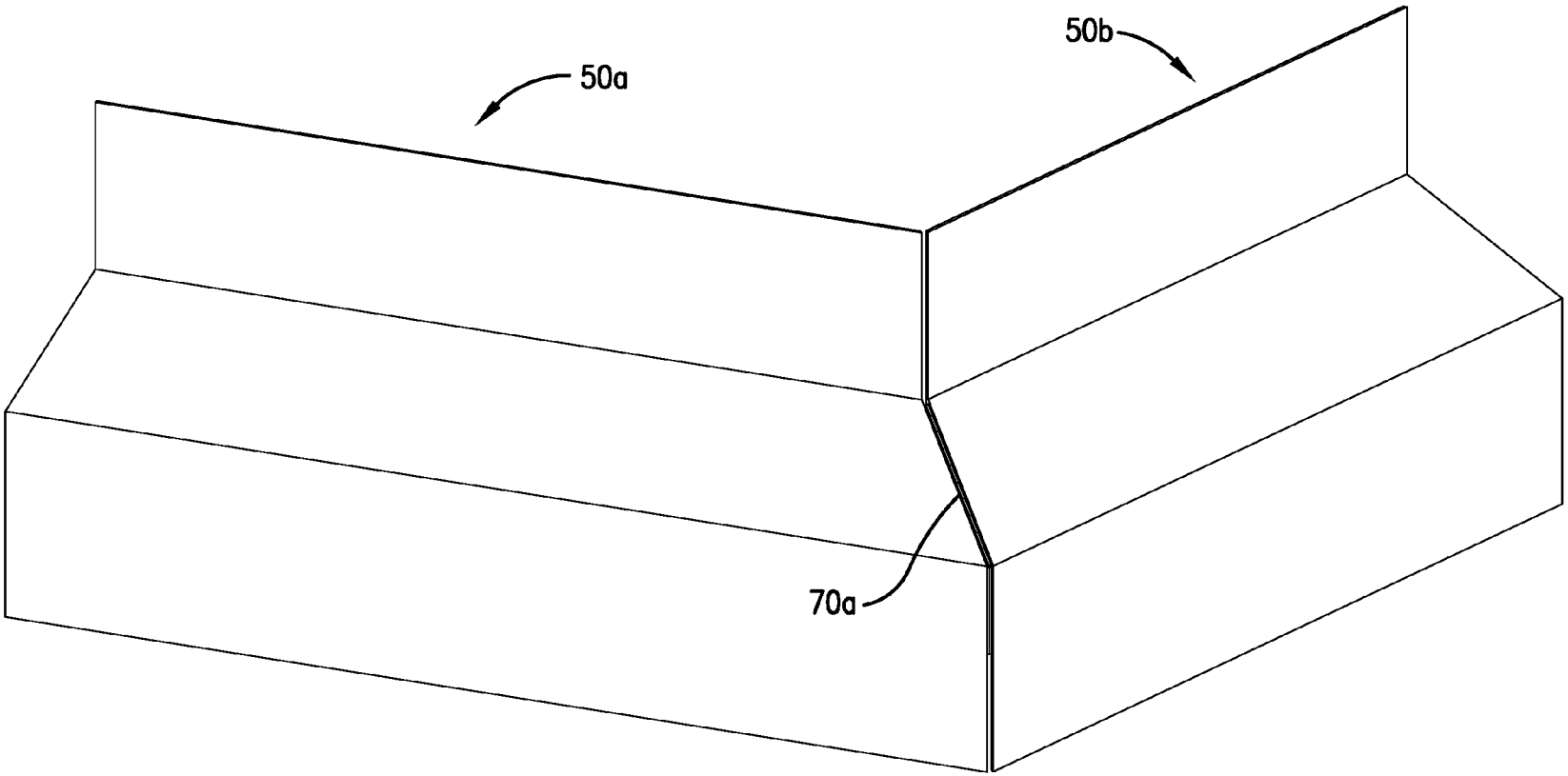
FIG. 7 is a perspective view of two horizontal joint covers having a seal in the gap therebetween and configured to be installed on a corner of an exterior wall, in accordance with one embodiment of the present invention.

Horizontal joint cover 50 may be secured to framing 20 of exterior wall 10 or to an area near the lower edge 26 of an upper panel 12. Regardless the embodiment, horizontal joint cover 50 should allow any water behind panels 12 to exit from the gap between upper panel 12 and framing 20. Horizontal joint cover 50 may be a single piece or be comprised of multiple pieces. As shown in FIG. 6 and FIG. 7, where two horizontal joint covers 50*a*, 50*b* butt together, seal 70 can be used to inhibit water flowing in the gap between joint covers 50*a*, 50*b*. Seal 70 can comprise tape, foam, or one of the materials used for seal 34 or second seal 60. Horizontal joint cover 50 may comprise a variety of shapes, depending on the specific application. For example, horizontal joint cover 50 may be flat, curved, angled, or otherwise shaped as needed to follow the siding panels 12. In certain embodiments, horizontal joint cover 50 comprises a material selected from the group consisting of aluminum, steel (e.g., formed, coated, or stainless steel), plastics or other polymers, fiber-cement, fiberglass, wood, composite materials, and combinations thereof. Horizontal joint cover 50 may be made from the same or different material as outer cover 38. Fiber cement, natural wood, or engineered wood may also be used as an aesthetic outer layer (not shown) of horizontal joint cover 50. While horizontal joint cover 50 is described herein as being a single part, it should be understood that horizontal joint cover 50 may be comprised of multiple pieces, which may be continuous or segmented.

Figure 8:
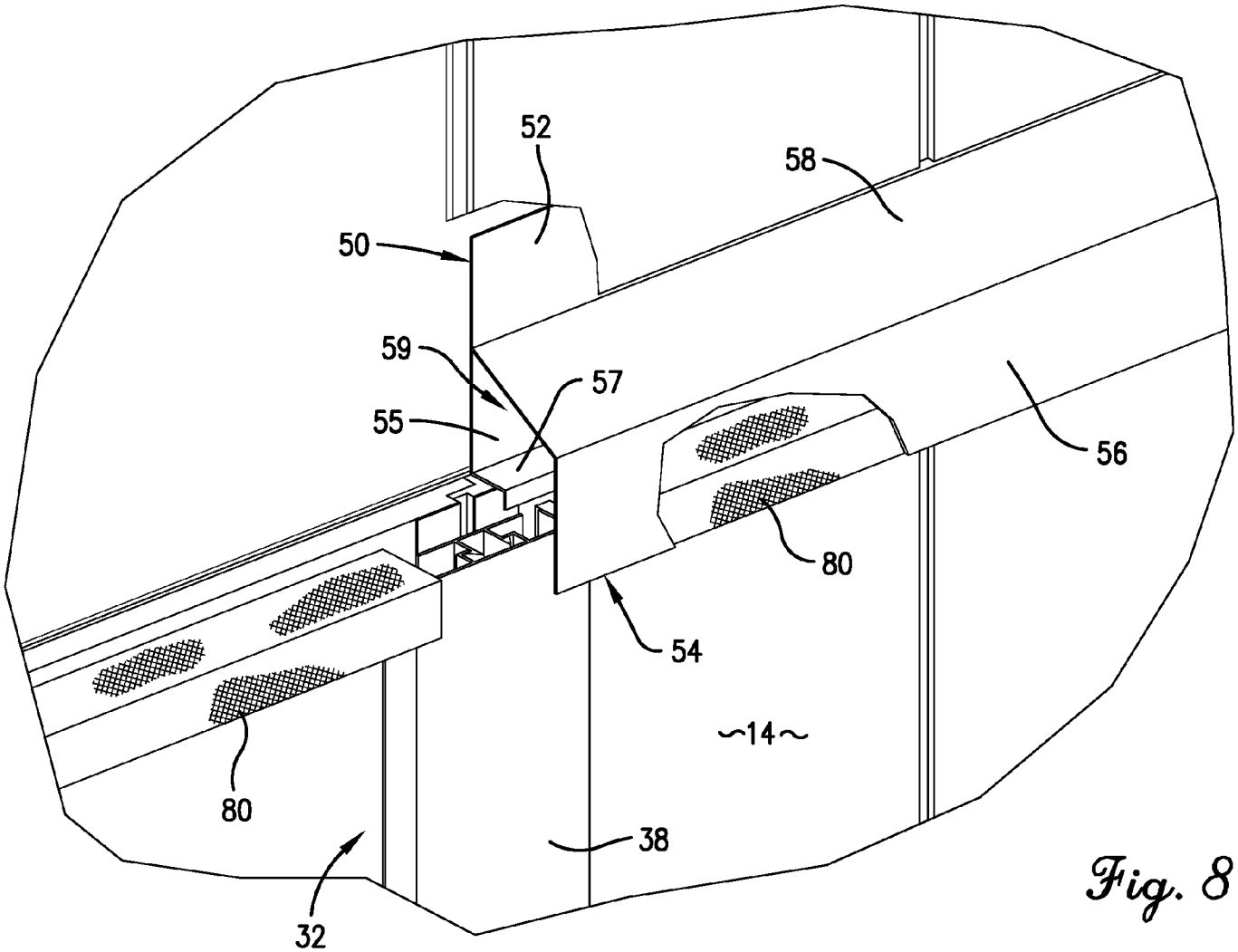
FIG. 8 is an enlarged cutaway perspective view of a water management system having a mesh screen installed thereon, in accordance with one embodiment of the present invention.

Water management system 30 may comprise one or more additional building components that impart a functional or aesthetic property. For example, as shown in FIG. 8, water management system 30 may further comprise mesh screen 80 installed beneath cavity 59 between overlay 56 and outer cover 38. Mesh screen 80 may be installed in any opening to the external environment and is designed to inhibit dirt, debris, insects, rodents, and other pests from entering water management system 30. In other embodiments, alternative constructions may be installed in place of, or in conjunction with, mesh screen 80, including segmented bristles, fins, louvers, open-cell foam, other air-permeable materials, or combinations thereof.

Figure 9:
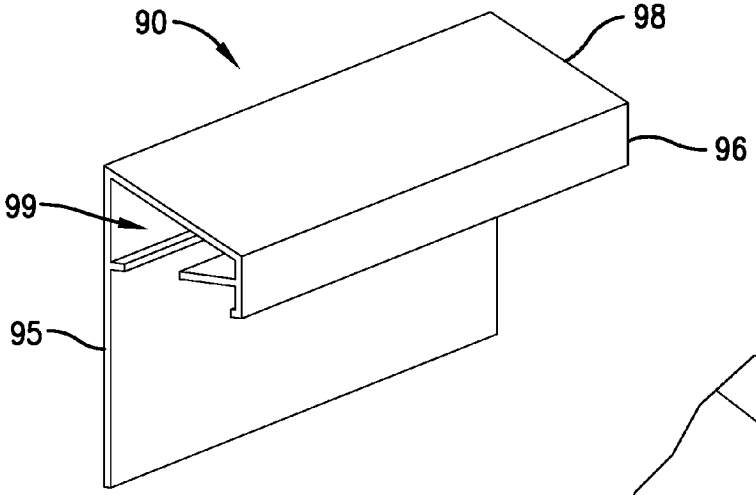
FIG. 9 is a perspective view of a starter strip part, in accordance with one embodiment of the present invention.
Figure 11:
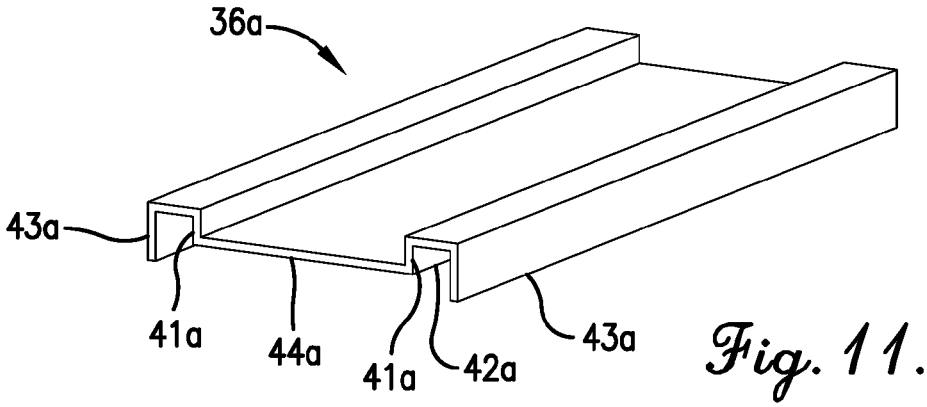
FIG. 11 is a perspective view of a bracket part of a batten assembly, in accordance with another embodiment of the present invention.

Water management system 30 may further comprise starter strip 90, as shown in FIG. 9. Starter strip 90 functions similar to horizontal joint cover 50 and may be installed above the upper-most panel(s) 12 on exterior wall 10. Starter strip 90 comprises lower flange 95, overlay 96, and a downward-sloping connecting member 98 between lower flange 95 and overlay 96. Starter strip 96 further presents a cavity 99 at least partially defined by the space between lower flange 95 and overlay 96. Cavity 99 is vented to the external environmental pressure, which allows air to flow through cavity 99 and drain any undesirable water from starter strip 90, while allowing dry air to flow through channel 40 of batten assembly 32. Starter strip 90 is designed to direct water away from the top of seal 34 installed on the upper-most panel 12 and prevent water from pooling beneath frieze board (not shown).

FIGS. 10-18 depict alternate embodiments of the bracket and outer cover of the batten assembly according to the present invention. For the sake of being concise, only those features that set the alternate embodiments apart from each other are discussed, and those features common to the various bracket and outer cover embodiments, while present, are not re-discussed. It is also understood that these embodiments are provided by way of illustration and should not be taken as limiting upon the scope of the present invention. Moreover, it is understood that any individual features of each bracket or outer cover may be combined with the features of other bracket or outer cover embodiments as desired to suit the needs of a particular water management system application.

Figure 10:
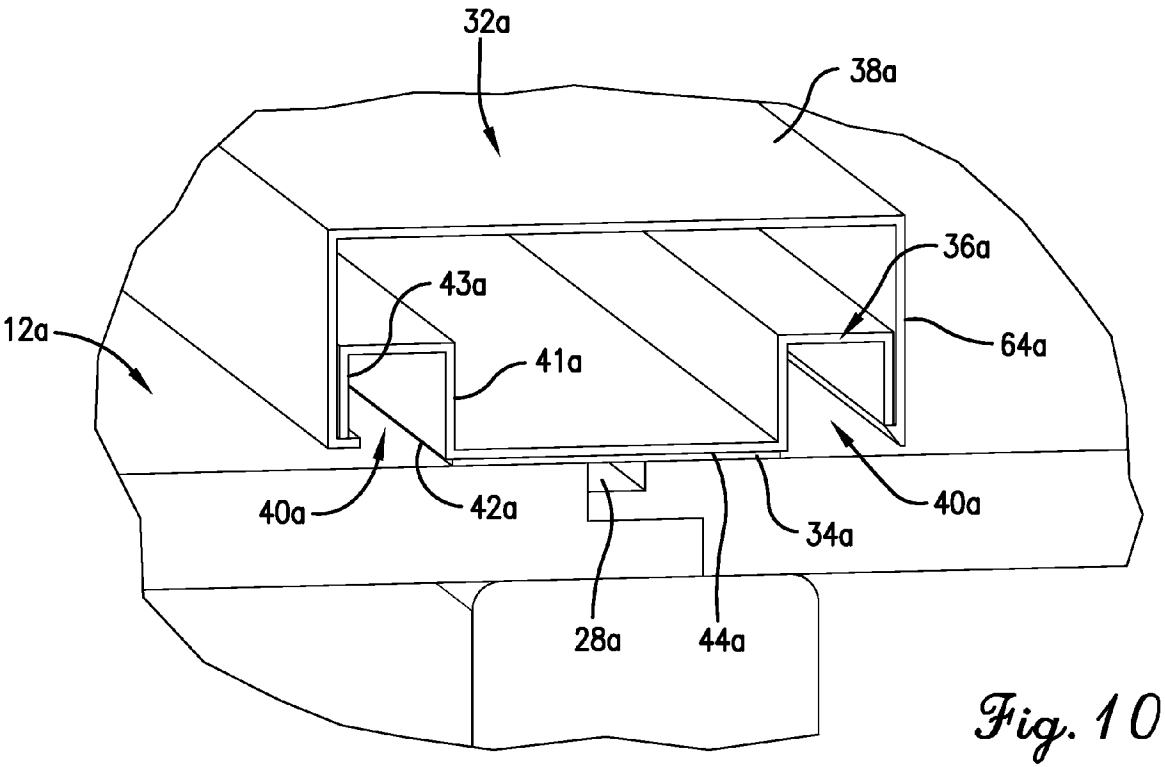
FIG. 10 is a perspective cross-section view of a batten assembly installed on an exterior wall, in accordance with another embodiment of the present invention.

Turning first to FIG. 10, an alternate embodiment of batten assembly 32*a* is shown. In this embodiment, the dimensions of the two channels 40*a* are defined by a pair of spaced-apart sidewalls 41*a*, 43*a* positioned along peripheral edges 42*a* of elongated bracket 36*a*. Seal 34*a* covers vertical joint 28*a* and is disposed between the first major surface 44*a* of bracket 36*a* and panels 12*a*. Outer cover 38*a* is installed over bracket 36*a* and secured by attaching outer members 64*a* to sidewalls 43*a*. This embodiment of elongated bracket 36*a* is also shown as an individual component in FIG. 11. Notably, when bracket 36*a* is installed, all dimensions of channel 40*a* are defined by bracket 36*a*.

Figure 12:
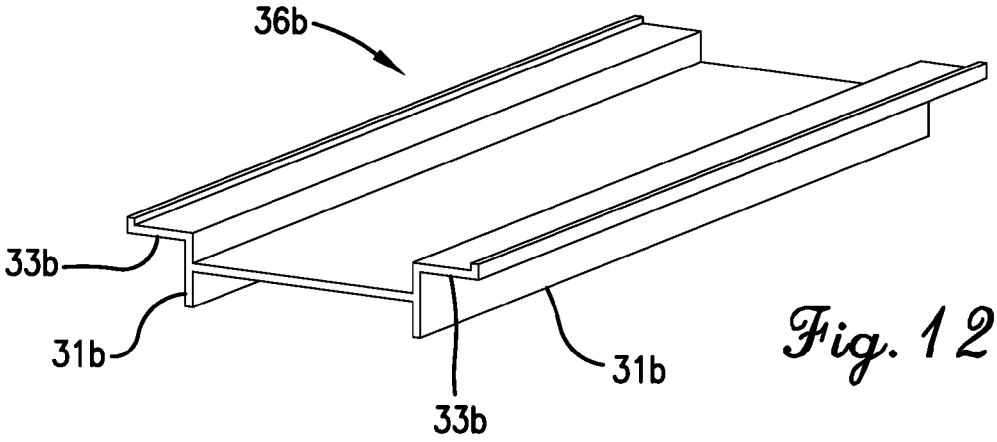
FIG. 12 is a perspective view of a bracket part of a batten assembly, in accordance with another embodiment of the present invention.
Figure 13:
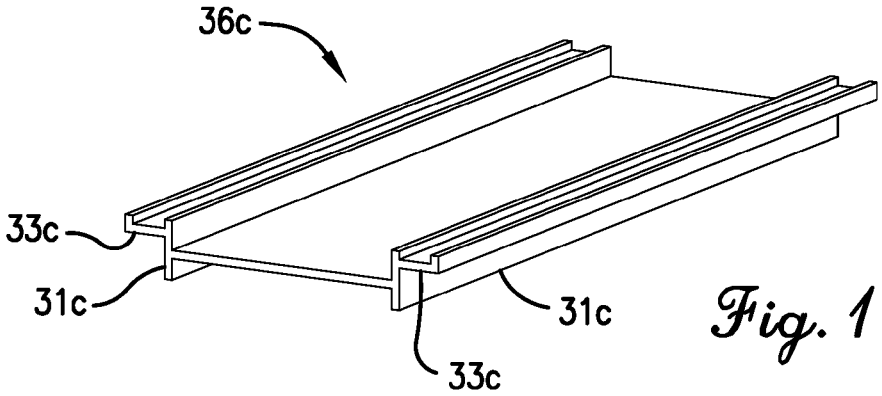
FIG. 13 is a perspective view of a bracket part of a batten assembly, in accordance with another embodiment of the present invention.

FIGS. 12 and 13 illustrate other embodiments of elongated bracket 36*b* and 36*c*, respectively. In these embodiments, elongated bracket 36*b*, 36*c* comprises side members 31*b*, 31*c* positioned along peripheral edges 42*b*, 42*c*. Side members 31*b*, 31*c*, further comprise a horizontal member 33*b*, 33*c*. When bracket 36*b*, 36*c* is installed, side members 31*b*, 31*c* provide an additional barrier to inhibit water from contacting seal 34 and also act as spacers to define the depth of two channels when the outer cover is installed. Horizontal members 33*b*, 33*c* define the width of the two channels.

Figure 14:
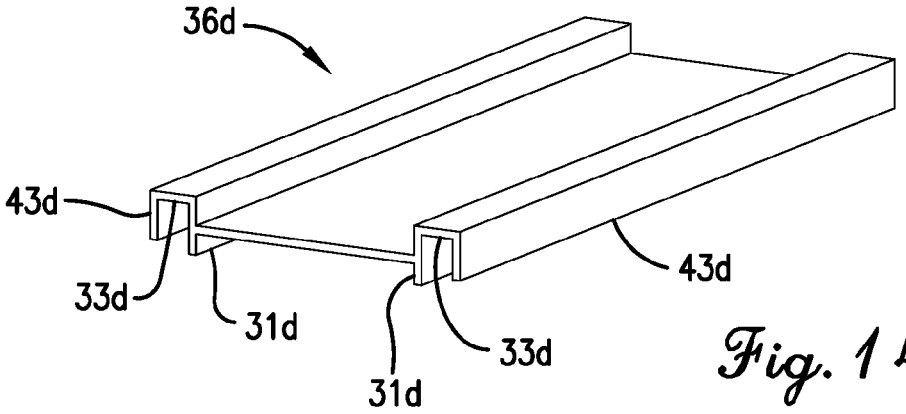
FIG. 14 is a perspective view of a bracket part of a batten assembly, in accordance with another embodiment of the present invention.
Figure 15:
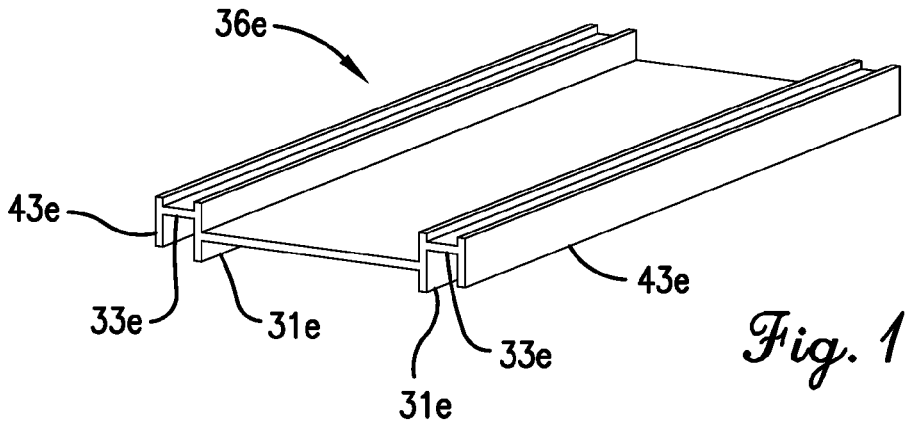
FIG. 15 is a perspective view of a bracket part of a batten assembly, in accordance with another embodiment of the present invention.

FIGS. 14 and 15 illustrate other embodiments of elongated bracket 36*d* and 36*e*, respectively. In these embodiments, side members 31*d*, 31*e* further comprise a horizontal member 33*d*, 33*e* and an opposed sidewall 43*d*, 43*e*. When installed, side members 31*d*, 31*e* and sidewalls 43*d*, 43*e* define the dimensions of two channels in the batten assembly.

Figure 16:
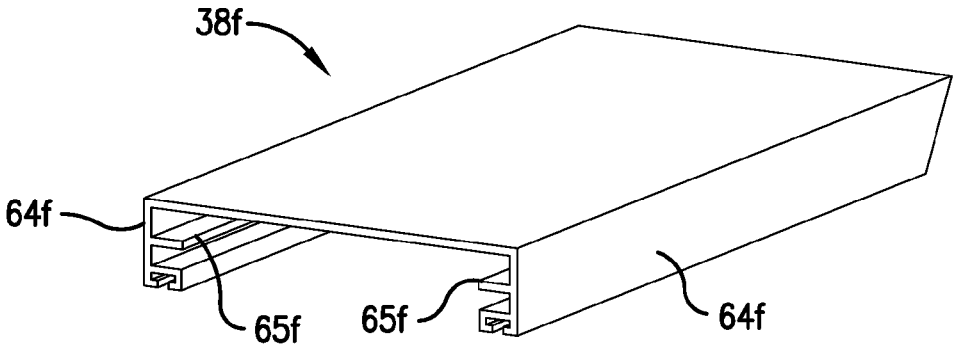
FIG. 16 is a perspective view of an outer cover part of a batten assembly, in accordance with another embodiment of the present invention.

FIG. 16 illustrates an alternate embodiment of outer cover 38*f*. In this embodiment, outer members 64*f* comprise horizontal fasteners 65*f* that are configured to slidably receive horizontal members 33*b* and 33*c* of the elongated brackets 36*b* and 36*c* in the embodiments of FIGS. 13 and 16.

Figure 17:
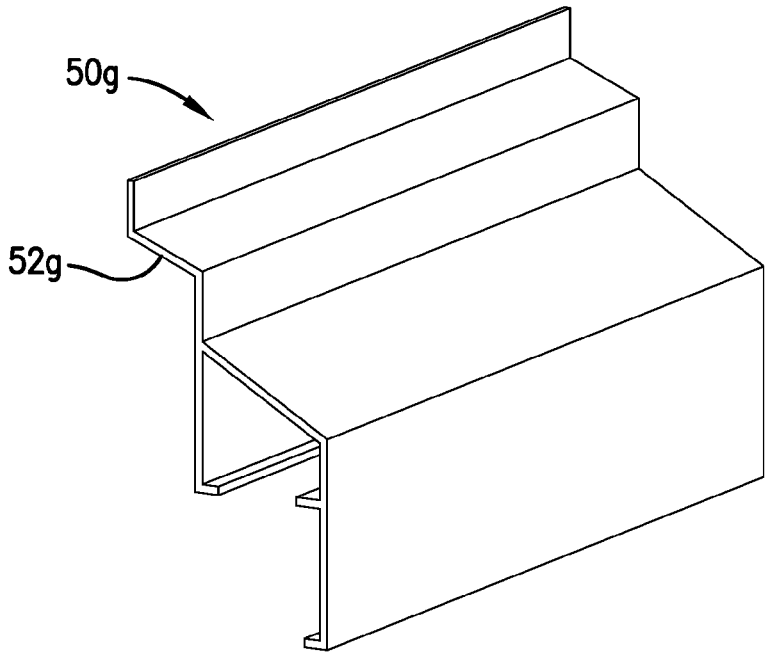
FIG. 17 is a perspective view of a horizontal joint cover, in accordance with another embodiment of the present invention.
Figure 18:
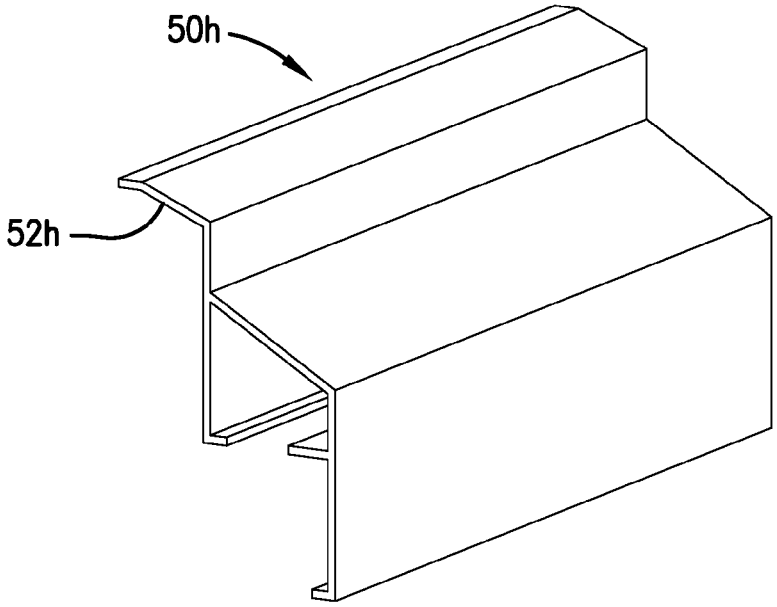
FIG. 18 is a perspective view of a horizontal joint cover, in accordance with another embodiment of the present invention.

FIGS. 17 and 18 illustrate alternate embodiments of horizontal joint cover 50*g* and 50*h*, respectively. In each of these embodiments, upper flange 52*g*, 52*h* is shaped to be installed on a different portion or type of exterior wall 10. Upper flange 52*g* is shaped to fit between a relatively narrow horizontal junction between an upper panel and lower panel. Upper flange 52*h* is shaped to be installed on a portion of the exterior wall where there is no framing adjacent the panel.

Water management system 30 can be used in a method of deterring water penetration through outer surface 14 of one or more exterior siding panels 12, in accordance with one or more embodiments of the present invention. The method generally comprises installing water management system 30 on outer surface 14 of siding panels 12. In certain preferred embodiments, water management system 30 is installed to substantially cover at least one passage on outer surface 14 with batten assembly 32. Advantageously, water management system 30 can be installed on pre-existing siding panels without substantially removing or replacing the panels. This saves considerable time and cost compared to the installation of conventional water management systems, which require removing the existing siding panels and replacing them with new siding material or covering nearly all of the existing panels with an extra layer of siding material.

Various installation methods in accordance with embodiments of the present invention are described below. However, the description herein is not intended to be limiting, and it should be understood that other installation techniques known by those in the art can be used within the scope of the present invention.

In one embodiment, there is provided a method of installing water management system 30 on an exterior wall without removing pre-existing siding panels. The method comprises first preparing the exterior wall for installation by removing any 1 trim and battens from an exterior wall, and cutting about 1 to about 2 inches from the lower edge of an upper panel, optionally using the pre-existing band board as a guide. At this point, the flashing, band board, and trimmed portion of the upper panel can be removed. The preparation step further comprises cleaning the outer surface to remove any loose dirt and debris, and sanding or scraping the surface as needed. The cut edge of the upper panel is then primed and any damaged or rotted wood is repaired as needed.

After preparing the wall, the method further comprises applying seal 34 to outer surface 14 over any vertical joints 28 and fasteners (not shown) on outer surface 14 of the pre-existing panels 12, starting from lower edge 26 of the lowest panel and running seal 34 up to and optionally around upper edge 24 of the lowest panel. Seal 34 should be applied up to the frieze board (not shown). In certain embodiments, starter strip 90 is then applied directly beneath frieze board by fastening to framing 20.

The method further comprises securing (e.g., fastening or adhering) bracket 36 over seal 34. A variety of fastening methods may be used, as described herein. Outer cover 38 is then partially secured to bracket 36, allowing for some movement necessary to install horizontal joint cover 50. In certain embodiments, however, outer cover 38 is secured to bracket 36 before fastening bracket 36 to seal 34. In certain alternative embodiments, seal 34 is fastened, adhered, or otherwise applied directly to bracket 36 instead of to outer surface 14, and bracket 36 is subsequently secured to outer surface 14.

Horizontal joint cover 50 can then be installed. In certain embodiments, horizontal joint cover 50 is installed by applying a bead of sealant or a gasket to upper edge 24 of lower panels, for example along internal portion 15. Upper flange 52 is then slid under an upper panel 12 and positioned between upper panel 12 and framing 20 adjacent inner surface 16, while horizontal projection 57 is positioned on top of a lower panel. Horizontal joint cover 50 can be secured into position by sliding horizontal joint cover 50 down against the bead of sealant or gasket on upper edge 24 of the lower panel until overlay 56 is overlapping the lower panel and outer cover 38, thereby sealing horizontal projection 57 to a lower panel 12, framing 20, and seal 34. In certain embodiment, horizontal joint cover 50 is then secured to wall 10 by inserting fasteners through surface 14 of upper panel 12 at locations that will be subsequently covered by upper batten assemblies 32.

In another embodiment, there is provided a method of installing water management system 30 on a new construction without pre-existing siding. The method comprises similar steps to those described above. However, the preparation steps can be omitted. Additionally, horizontal joint cover 50 may be applied prior to installation of upper siding panels. Finally, starter strip 90 may be modified to insert under frieze board.

In still another embodiment, there is provided a method of installing water management system 30 around window 22 on an exterior wall 10. The method can also be used to install water management system 30 around a door. The method first comprises preparing the exterior wall for installation. If applicable, the preparation step comprises removing trim and battens, and cutting about 1 inch of siding around the window to expose the nailing fin, optionally using the window frame as a guide. The preparation step further comprises cleaning the outer surface to remove any loose dirt and debris, and sanding or scraping the surface as needed. The cut edge of the panel is then primed and any damaged or rotted wood is repaired as needed.

The method further comprises applying seal 34 to window frame 22 between the window and framing 20, and between framing 20 and siding panels 12 at the window sill and jambs. At the head, seal 34 is applied between the window frame 22 and framing 20. At this point, any additional sealant or flashing (i.e., z-trim) is applied as needed or desired. Horizontal joint cover 50 and starter strip 90 are then installed, as described above. The method further comprises fastening bracket 36 over seals 34 on vertical surfaces above the head, next to jambs, and beneath the sill of the window 22 and securing outer cover 38 to bracket 36, as described above.

Water management system 30 provides a robust system that inhibits or prevents water penetration in exterior panel siding walls. The system reduces the need for frequent re-caulking and re-painting of the exterior of the siding, as compared to prior art water management systems, thereby lowering the long-term cost of building maintenance. Because the present invention is specifically designed to protect the most vulnerable areas of the exterior siding system (panel joints and fastener locations), it can be implemented at a lower cost than other siding systems which would otherwise cover the entire exterior surface of the wall.

The invention claimed is:

1. A method of deterring water penetration through an outer surface of two or more exterior siding panels comprising at least one upper panel and at least one lower panel having a junction therebetween, the method comprising installing a water management system on the outer surface of the siding panels, wherein the water management system comprises a vertical batten assembly secured to the outer surface of the siding panels and comprising an elongated bracket and an outer cover that covers at least a portion of the bracket;

a seal positioned adjacent the bracket and disposed at least partially between the bracket and the siding panels, wherein the batten assembly presents a channel running substantially parallel to the elongated bracket and configured to permit fluid to drain from the batten assembly; and a horizontal joint cover, the horizontal joint cover comprising an upper flange positioned adjacent to an interior surface of the upper panel;

a lower projection comprising a lower flange and a spaced apart overlay, the lower projection presenting a cavity at least partially defined by the lower flange and the spaced apart overlay and configured to permit fluid drain from the horizontal joint cover, the lower flange comprising a horizontal projection positioned along an upper edge of the lower panel, wherein the spaced apart overlay is positioned to cover at least a portion of the outer cover of the vertical batten assembly; and a connecting member between the upper flange and the overlay, the connecting member having a downward sloping angle relative to the upper flange and configured to divert fluid away from the junction between the upper siding panel and the lower siding panel.

2. The method of claim 1, wherein the two or more siding panels comprise at least one passage open to fluid flow formed therein, the installing comprising substantially covering the at least one passage with the vertical batten assembly.

3. The method of claim 2, wherein the at least one passage open to fluid flow is selected from the group consisting of vertical joints, fastener perforations, and frame gaps.

4. The method of claim 1, wherein the two or more exterior siding panels are pre-existing siding panels, the water management system being installed without substantially removing or replacing the plurality of pre-existing siding panels on the exterior wall.

5. The method of claim 1, wherein the installing comprises applying the seal to the outer surface and subsequently securing the first major face of the elongated bracket to the seal, thereby securing the bracket to the outer surface.

6. The method of claim 5, wherein the installing further comprises attaching the outer cover to the bracket after securing the bracket to the outer surface.

7. The method of claim 5, wherein the installing further comprises attaching the outer cover to the bracket before securing the bracket to the outer surface.

8. The method of claim 1, wherein the installing further comprises applying a second seal to the outer surface, the second seal being at least partially disposed between the outer cover of the batten assembly and the outer surface.

* * * * *